United States Patent [19]

Silvestri, Jr.

[11] Patent Number: 4,957,410

[45] Date of Patent: Sep. 18, 1990

[54] STEAM TURBINE FLOW DIRECTION CONTROL SYSTEM

[75] Inventor: George J. Silvestri, Jr., Winter Park, Fla.

[73] Assignee: Westinghouse Electric Corp., Pittsburgh, Pa.

[21] Appl. No.: 306,188

[22] Filed: Feb. 6, 1989

[51] Int. Cl.[5] ..... F01D 25/30

[52] U.S. Cl. ..... 415/169.1; 415/20; 415/914

[58] Field of Search ..... 415/169.1, 169.2, 169.3, 415/169.4, 20, 49, 914, 1

[56] References Cited

U.S. PATENT DOCUMENTS

| | | | |
|---|---|---|---|
| 3,694,102 | 9/1972 | Conrad | 415/169.1 |
| 3,966,355 | 6/1976 | Pierpoline | 415/169.1 |
| 4,720,235 | 1/1988 | Lachance et al. | 415/914 |
| 4,844,689 | 7/1989 | Seed | 415/169.1 |

FOREIGN PATENT DOCUMENTS

| | | | |
|---|---|---|---|
| 1115125 | 4/1956 | France | 415/169.4 |
| 26213 | 2/1982 | Japan | 415/169.4 |
| 176404 | 10/1983 | Japan | 415/169.3 |
| 168999 | 7/1987 | Japan | 415/169.4 |
| 387361 | 2/1933 | United Kingdom | 415/169.4 |
| 619722 | 3/1949 | United Kingdom | 415/914 |

*Primary Examiner*—John T. Kwon

[57] ABSTRACT

A method and system for maintaining forward flow direction and controlling the path of steam flow following trips of reheat turbines, by maintaining pressure differentials to control the direction and path of the steam flow. After a turbine trip, pressure at the exhaust stage is reduced by extracting steam at a point just upstream of the exhaust and dumping it to a lower pressure zone, feedwater heater, or condenser. Additionally, pressure is increased at the inlet by introducing HP exhaust into the impulse chamber. Secondly, pressure is reduced on the concave, pressure side of turbine blading nearest the turbine exhaust by applying suction to steam collection channels running the length of the pressure surfaces thereof, thereby keeping the path of steam flow in contact with the pressure surfaces of the blades.

18 Claims, 4 Drawing Sheets

STEAM TURBINE FLOW DIRECTION CONTROL SYSTEM

BACKGROUND OF THE INVENTION

This invention relates to steam turbines, and more particularly, to a system and method for reducing turbine blade overheating and consequent distress that occurs because of turbine windage heating following trips of reheat turbines.

Following a turbine "trip", i.e., when high pressure steam from a boiler to a turbine impulse chamber is suddenly shut off, the steam flow in a high pressure (HP) element of a single stage reheat turbine can reverse in less than one second. By impulse chamber is meant a zone either ahead or immediately after a first stage in which a drain is located. The reason for such reversal is that closure of steam interceptor valves keeps the HP exhaust pressure at an elevated level, while the pressure at the HP inlet decays because of leakage around the turbine shaft and flow removal through the moisture drain system. In a double reheat turbine, the same situation also occurs between reheats.

It is well known that when there is reverse or negative steam flow, windage heat generation is higher with normal forward rotation of the turbine blades than with reverse or negative rotation. In the case of normal forward flow, windage heating in lower with forward positive rotation than with reverse, negative rotation. With respect to reverse flow and forward rotation, the flow capability is poorer because the flow is entering the blade passage from the wrong direction and the flow area is decreasing rather than increasing as the flow traverses the blade path from normal exhaust to inlet.

It has also been established that the highest windage losses during reverse flow and forward or normal rotation occur when the flow follows the suction or convex side of the blade passages. This phenomenon, in which the flow follows the passage wall that diverges from the flow direction, has been called the Coanda effect. (Normal forward flow typically tends to follow the wall that turns into the flow and the concave boundary or pressure side of the blade passage.) Occurrence of the Coanda effect during reverse flow conditions further increases losses by increasing windage heating.

The conventional solution to the problem of windage heating has involved heat removal by supplying sufficient ventilating steam to control the temperature so that blade distress does not occur. However, it is very difficult to evaluate forward rotation with reverse flow conditions, and despite detailed investigations of this problem, temperature predictions based on calculations extrapolating forward rotation, forward flow data have been overly conservative. The uncertainty of the analysis becomes successively greater with each stage that the steam passes through, as each stage adds some increment of incorrect temperature increase to the temperature of the preceding stage. These overly conservative predictions have resulted in designs in which the ventilating or drain valves supplied on ventilation systems are larger than they probably need be, at increased cost. Prevention of reverse flow would reduce the windage heating problem, thereby reducing the requirements and costs of the ventilation system, and would allow more accurate predictions of windage heating using the experimental data already availabe for a forward rotation, forward flow regime.

Accordingly, it is an object of this invention to reduce windage heating of turbine blades by controlling the direction of steam flow and eliminating the Coanda effect after a turbine trip.

SUMMARY OF THE INVENTION

The present invention provides a method and system for maintaining forward flow direction and controlling the path of steam flow following trips of reheat turbines, by maintaining pressure differentials to control the direction and path of the steam flow. After a turbine trip, pressure at the exhaust stage is reduced by extracting steam at a point just upstream of the exhaust and dumping it to a lower pressure zone, feedwater heater, or condenser. Additionally, pressure is increased at the inlet by introducing HP exhause into the impulse chamber. Secondly, pressure is reduced on the concave, pressure side of turbine blading nearest the turbine exhaust by applying suction to steam collection channels running the length of the pressure surfaces thereof, thereby keeping the path of steam flow in contact with the pressure surfaces of the blades.

BRIEF DESCRIPTION OF THE DRAWINGS

For a better understanding of the present invention, reference may be had to the following detailed description taken in conjunction with the accompanying drawings in which.

DETAILED DESCRIPTION OF THE DRAWINGS

Figure 1A:
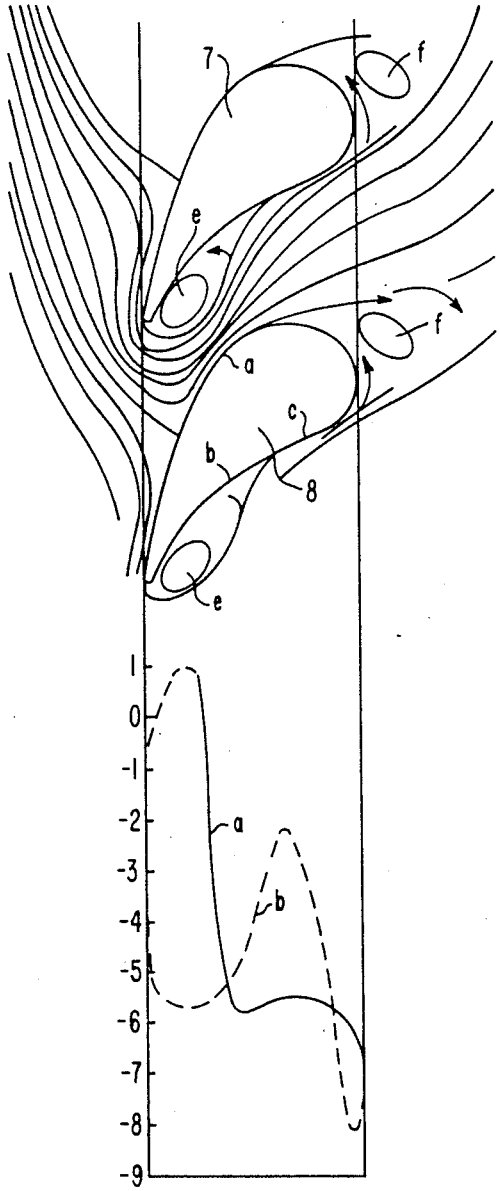
FIGS. 1A and 1B show pressure distribution and quanlitative flow lines of steam in a turbine under back flow conditions.
Figure 1B:
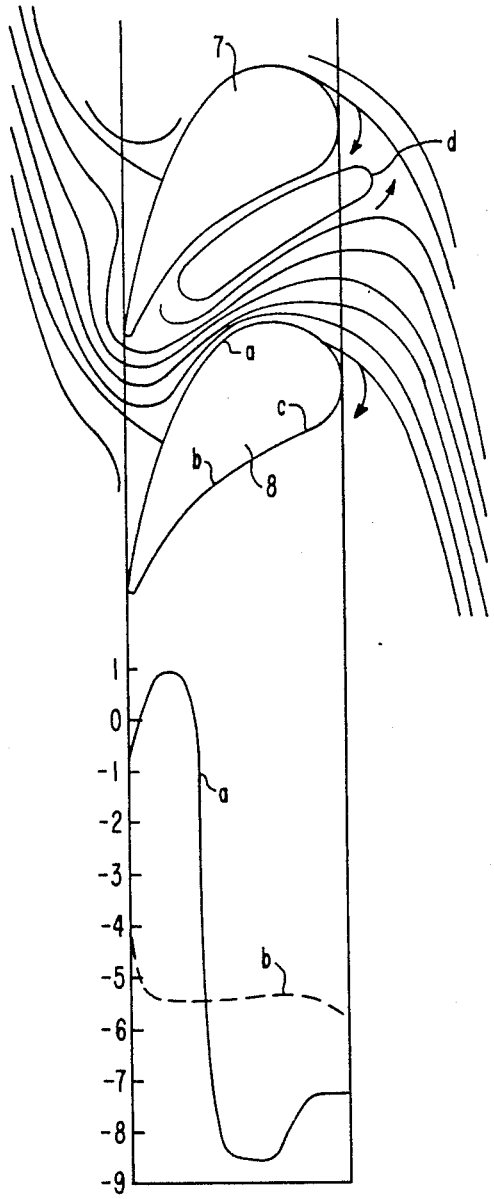

During reverse steam flow and forward or normal rotation of blades in a steam turbine, there is increased windage about the blades as is illustrated in the two diagrams of pressure distribution and qualitative flow lines in FIGS. 1A and 1B. FIG. 1A shows deflection of steam flow about two adjacent turbine blades 7, 8 without Coanda effect, and FIG. 1B shows deflection about the blades 7,8 with Coanda flow. The Coanda effect causes the flow to follow the suction or convex side 'a' of a blade passage where the passage wall diverges from normal flow direction. A large separation cell 'd' appears when the Coanda effect is present, as opposed to two much smaller separation cells 'e', 'f' when the effect is absent. Published reports on reverse turbine flow and reverse rotation have established that higher windage heating produces blade distress when the Coanda effect is present. The graphs of FIGS. 1A and 1B illustrate pressure through the blade region.

Figure 2:
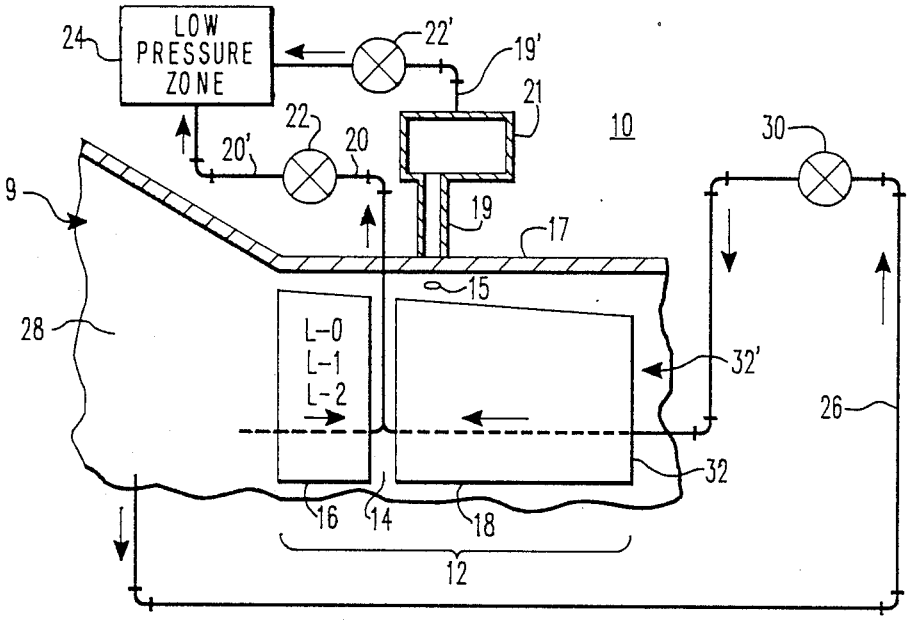
FIG. 2 is a schematic diagram of one form of steam flow direction control system in accordance with the present invention.

FIG. 2 is a simplified partial cross-sectional schematic diagram of a steam turbine 9 incorporating a flow direction control system 10 for an HP turbine section 12 in accordance with the present invention. At a location 14 preceding the last two turbine stages L-0 and L-1 of the HP turbine, indicated at 16, and following the remaining upstream stages 18 of HP turbine section 12, steam is extracted through a conduit 20, controlled by a valve 22, and thereafter led to a lower pressure zone 24, such as a condenser or feedwater heater.

Some turbine units incorporate an extraction pipe or conduit (not shown) for a feedwater heater at point 14. In that case, conduit 20, which would be smaller than such a feedwater heat extraction pipe, could tap into the larger extraction pipe in the turbine side of a non-return valve, not shown but normally present in such extraction pipes. If there is no feedwater heater extraction pipe already in existence, holes 15 could be formed through the pressure vessel wall 17 and mated with pipes 19 taking the steam to a collection manifold 21 and then to the lower pressure zone 24. A valve 22' could be positioned between the manifold 21 and zone 24. It will be appreciated that while both a pipe 19 and a conduit 20 are shown in the schematic illustration of FIG. 2, it is appreciated that only one of these two extraction means would be used on any one turbine.

Additionally, a line 26 from a turbine exhaust 28, fitted with a control valve 30, introduces exhaust steam into an inlet 32' of an impulse chamber 32 of the high pressure turbine section 12. This system 10 produces a reduction in blade path temperature for two reasons. First, flow reversal after a turbine trip would occur only in the last two stages 16 of the turbine before being removed. The remaining upstream stages 18 would not experience increasing temperatures resulting from reverse flow. The uncertainties in predicting temperatures from reverse flow would thus be restricted to the last two stages 16.

Secondly, exhaust steam entering impulse chamber 32 would flow in the normal direction and would exit through lines 19 or 20, thereby reducing windage losses. Since experimental data has been obtained for this condition, the windage loss predictions for this set-up will be fairly accurate. The highest temperatures are encountered at stages L-1 and L-2, whereas with the flow direction control system 10 of the present invention, temperature continuously increases through all stages from turbine outlet to turbine inlet.

Figure 4:
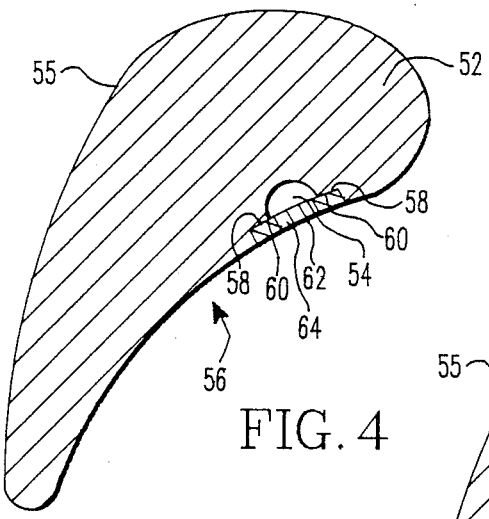
FIG. 4 is a simplified cross-sectional view of a turbine blade incorporating one form of collection channel in a blade.
Figure 5:
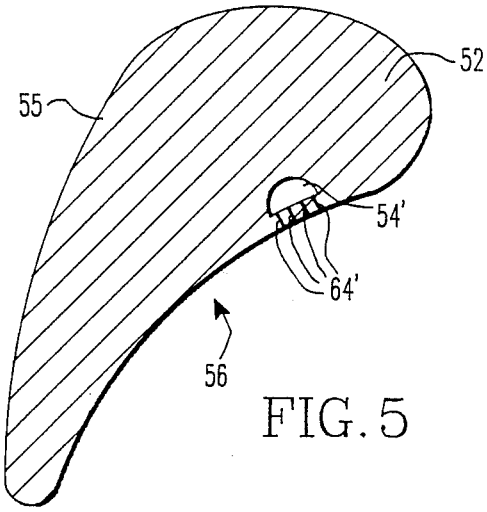
FIG. 5 is similar to FIG. 4, showing an alternative construction of a collection channel.
Figure 3:
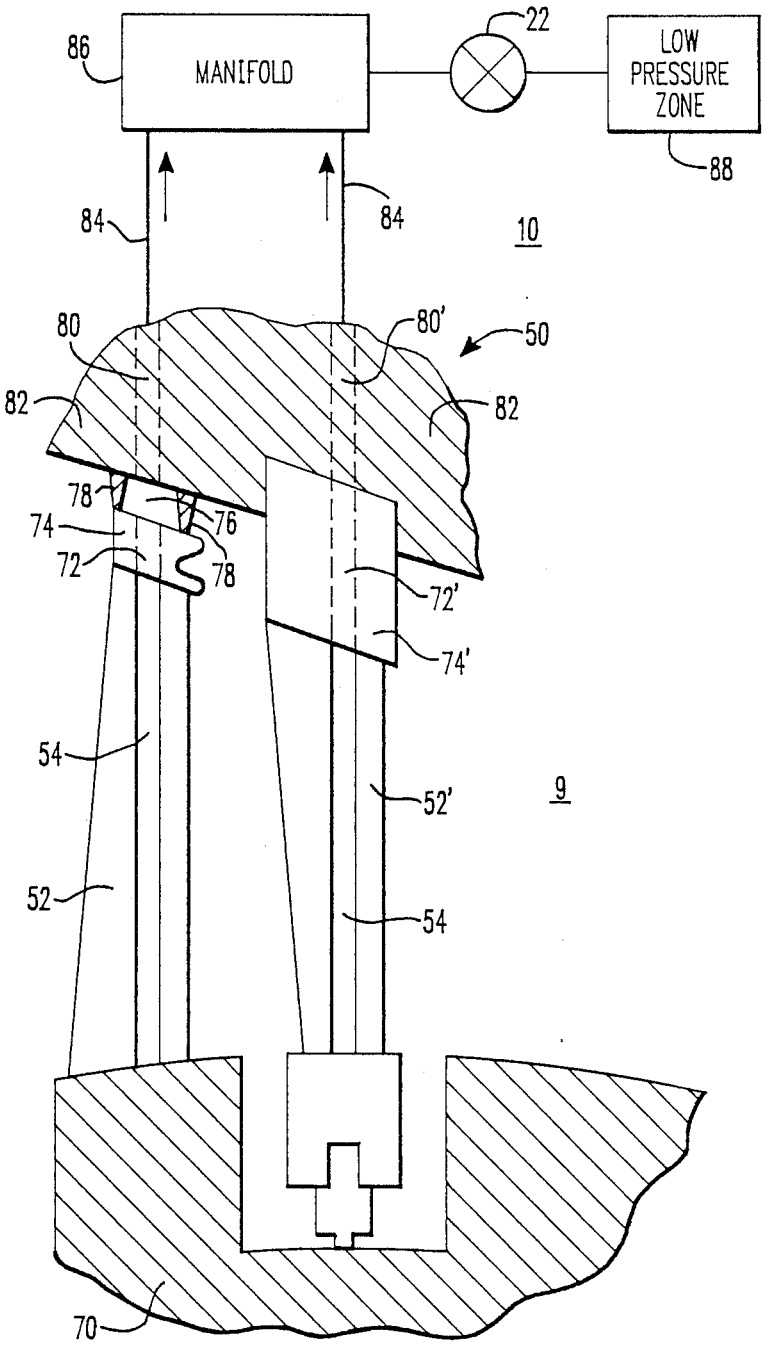
FIG. 3 is a partial cross-sectional view of a turbine and inside of its casing showing a collection channel in the turbine blading together with connecting bores through the turbine casing to a collection zone and extraction means in accordance with another form of the present invention.

FIGS. 3–5 depict another feature of the present invention in which suction is used on the pressure surfaces of turbine blading to keep steam flow in contact with those surfaces. A cross-section of a blade 52 is shown in FIG. 4 with a semi-circular collection channel 54 forged or machined into the pressure surface 56 of blade 52 from base to tip of the blade for extraction of steam. As was described above, the suction surface 55 does not experience the same flow deviations. Channel 54 need not be semicircular; however, this configuration has a favorable hydraulic radius. On either side of channel 54 there is a recess 58, for receiving edges 60 of a perforated plate or screen 62. Plate 62 is welded into place, and is similar in appearance to the blade foil material used on higher temperature gas turbines that employ transpiration cooling. As used in the present invention, steam is suctioned though the perforations 64 to hold steam flow passing blade 52 in contact with the pressure surface 56. Perforations 64 should have faired or rounded inlets to enhance flow capability. The finished welds at recesses 58 are dressed to create a contour of the blade surface 56 the same as that of an unmodified blade.

Some blade materials are difficult to weld, such as those of twelve percent chromium alloy. An alternative embodiment, as shown in FIG. 5, obviates the welding problem. Electro discharge machining is used to create the collection channel 54' and perforations 64'. Collection channel 54' could be a lengthwise cylindrical bore instead of a semicircular depression, obviating the need for a separate cover plate, and the perforations 64' through pressure surface 56 would then be of varying depth, depending upon the point of intersection with the rounded wall of the channel.

FIG. 3 illustrates schematically the passages leading the extracted steam from connecting channel 54 in a rotating blade 52 and a stationary blade 52' through the turbine casing 82. Because the embodiment illustrated in FIG. 3 is slightly different from that of FIG. 2 in the details of the steam collection system, different reference numbers have been assigned to components of the system. However, it will be recognized that casing 82 is equivalent to casing 17, manifold 21 is equivalent to manifold 86, pipes 19, 20 are equivalent to pipes 84, holes 15 are equivalent to holes 80, and condenser 24 is equivalent to low pressure zone 88. Channels 54 connect to bores 72 drilled or formed through blade shrouds 74. In the case of rotating blade 52, bore 72 opens into a space 76 between sealing rings 78. Seal rings 78 on either side of shroud 74 prevent steam extracted via channels 54 from being dissipated within the turbine, and also maintain the pressure in channels 54 at a lower level than the blade path pressure. In units where the rotating blades have no shrouds (not shown), channels 54 will empty directly into space 76. A plurality of bores 80 through casing 82 communicate with space 76, bores 80 being connected by duct means 84 to a collection manifold 86, connected in turn to a lower pressure zone 88, which could be a feedwater heater, condenser, or eductor supplied with motive steam from the boiler.

In the case of stationary blade 52', there are no seal rings 78 and consequently no space 76. A bore 72' through shroud 74' is coupled directly to bore 80' through casing 82.

With steam flow leaving blade 52 at an angle more closely approximating the pressure surface 56, the steam flow enters the next blade row at a more optimum angle, thereby reducing windage losses. The rotational effects on the rotating rows of blades enhances the flow of steam through the collection channel. Cascade tests can be used to determine the optimum location of the collection channel 54 and perforations 64 for elimination of Coanda flow, and also the optimum degree of bleeding of steam through channel 54 to ensure adherence of flow to the pressure surface 56. In an alternative embodiment of the invention, two channels per blade, one near the trailing edge and one near the leading edge, may be used.

The embodiment of the present invention illustrated in FIG. 3 may be employed in various configurations. For instance, since improved flow from one blade row improves flow in the blade row that follows, the invention could be used in alternating rows, i.e., on only the rotating blade rows, or only the stationary blade rows. Although rotation enhances flow in the blades, the rotating blades are more highly stressed; also, low pressure blades which are slender, twisted and tapered, present problems in the fabrication of the slots or channels 54. Therefore, it may be desirable to apply the invention only to the stationary blading of a low pressure unit.

While the principles of the invention have now been made clear in an illustrative embodiment, it will become apparent to those skilled in the art that many modifications of the structures, arrangements and components presented in the above illustrations may be made in the practice of the invention in order to develop alternative embodiments suitable to specific operating requirements without departing from the scope and principles of the invention as set forth in the claims which follow.

What is claimed is:

1. In a reheat steam turbine having at least one turbine element with an impulse chamber and an exhaust stage, the steam turbine having other elements and zones wherein the pressure is lower than that of the exhaust stage, a system for reducing windage heating and resulting distress to turbine blading by prevention of Coanda-type flow, comprising:

outlet means located upstream of the exhaust stage for extraction of steam therethrough;

first duct means connecting said outlet means to a relatively low pressure zone;

first valve means connected to said duct means for controlling steam flow through said outlet means;

inlet means into the impulse chamber for introduction of exhaust steam from the exhaust stage;

second duct means connected between said inlet means and the exhaust stage; and second valve means connected to said second duct means for controlling the flow to exhaust steam into the impluse chamber.

2. The system according to claim 1 wherein said lower pressure zone comprises a feedwater heater.

3. The system according to claim 1 wherein said lower pressure zone comprises a condenser.

4. The system according to claim 1 wherein said outlet means comprises a plurality of bores through the turbine wall, and further comprising a collection manifold connected between said duct means and said lower pressure zone.

5. In a reheat steam turbine having at least one turbine section with an impulse chamber and an exhaust stage, the turbine section having an extraction pipe with an non-return valve upstream of the exhaust stage for extracting steam for application to a feedwater heater, a system for reducing windage heating and resulting distress to turbine blades by prevention of Coanda-type flow, comprising:

first duct means tapping into the extraction pipe upstream of the non-return valve for extraction of steam therethrough, said duct means being connected to a lower pressure zone of the turbine;

first valve means connected to said first duct means for controlling steam flow through said duct means;

inlet means into the impulse chamber for introduction of exhaust steam from the exhaust stage;

second duct means connected between said inlet means and the exhaust stage; and second valve means connected to said duct means for controlling the flow of exhaust steam into the impulse chamber.

6. In a reheat steam turbine having a plurality of alternating rows of fixed and rotating blades, each of the blades having a pressure surface and a suction surface, a system for reducing windage heating and resulting distress to turbine blades by prevention of Coanda-type flow, comprising:

collection channels formed in a pressure surface of selected ones of the turbine blades, each of said channels extending lengthwise from an inner end to an outer end of a corresponding blade;

a collection zone positioned adjacent to the outer end of the blades for collecting steam flowing through said collection channels;

suction means connected to said collection zone for extracting collected steam and for maintaining pressure in said collection channels lower than the pressure in a blade path within the turbine; and means for controllably transferring steam from an exhaust stage of the trubine to an impulse chamber of the turbine.

7. The invention according to claim 6 wherein each of said collection channels is covered by a perforated plate, the outer surface contour of said plate being continuous with the pressure surface of the corresponding blade.

8. The invention according to claim 6 wherein said collection zone comprises a plurality of bores through the turbine casing, each bore being positioned to receive steam from one or more of said collection channels.

9. The invention according to claim 8 wherein said collection zone further comprises an annular collection chamber for each rotating blade row comprising a space between the outer ends of the rotating blades in a row and the inner wall of the turbine casing, said space being enclosed by a pair of sealing rings attached at their outer circumferences to said inner wall on either side of a corresponding blade row and in contact at their inner circumferences with the outer ends of blades in the blade row.

10. In a reheat steam turbine having at least one turbine section with an impulse chamber and an exhaust stage, the steam turbine having other sections and zones wherein the pressure is lower than that of the exhaust stage, the turbine section having a plurality of alternating rows of radially extending fixed and rotating blades and each of the blades having a pressure surface, a system for reducing windage heating and resulting distress to the turbine blades by prevention of Coanda-type flow, comprising:

outlet means located upstream of the exhaust stage for extraction of steam therethrough;

first duct means connecting said outlet means to a lower pressure zone of the turbine;

inlet means into the impulse chamber for introduction of exhaust steam from the exhaust stage;

second duct means connected between said inlet means and the exhaust stage;

a collection channel formed in the pressure surface of selected ones of the turbine blades, said channel extending from an inner end to an outer end of each blade for providing a radially directed from flow path;

a collection zone positioned adjacent the outer end of each of the blades with channels for collecting steam flowing through said channels; and suction means connected to said collection zone for extracting collected steam and for maintaining pressure in said collection channels lower than the pressure in the blade path within the turbine.

11. The invention of claim 10 and including valve means connected to said duct means for controlling steam flow through said outlet means.

12. The invention of claim 10 and including second valve means connected to said second duct means for controlling steam flow into the impulse chamber.

13. The invention according to claim 10 wherein each of said collection channels is covered by a perforated plate, the outer surface contour of said plate being continuous with said pressure surface.

14. The invention according to claim 10 wherein said collection zone comprises a plurality of bores through the turbine casing, each bore being located for passing steam from one or more of said collection channels.

15. The invention according to claim 14 wherein said collection zone further comprises an annular collection chamber for each rotating blade row comprising a space between the outer ends of the rotating blades in a row and an inner wall of the turbine casing, said space being enclosed by a pair of sealing rings attached at their outer circumference to the turbine casing inner wall on either side of said blade row and in contact at their inner circumference with the outer ends of the rotating blades.

16. In a reheat steam turbine having at least one high pressure turbine section with an impulse chamber and an exhaust stage, the steam turbine having other sections and zones wherein the pressure is lower than that of the exhaust stage of the high pressure section, the high pressure section having a plurality of rows of rotating blades attached to the turbine rotor alternating with rows of fixed blades attached to an inner wall of a casing surrounding the turbine, each of the blades having a pressure surface and a suction surface, the blades of each row being connected at their radially outer ends to shroud bands, the inner wall having sealing rings attached adjacent each shroud band of a rotating blade to minimize steam leaking past the shroud bands, a system for reducing windage heating and resulting distress to turbine blades by prevention of Coanda-type flow, comprising:

outlet means located upstream of the exhaust stage of the high pressure section, for extraction of steam therethrough;

first duct means connecting said outlet means to a lower pressure zone of the turbine;

first valve means connected to said duct means for controlling steam flow through said outlet means;

inlet means coupled to said impulse chamber for introduction of exhaust steam from the exhaust stage of the high pressure section;

second duct means connected between said inlet means and the exhaust stage;

second valve means connected to said second duct means for controlling the flow of exhaust steam into the impulse chamber;

a collection channel formed on the pressure surface of selected ones of the turbine blades, each channel extending radially from inner end to outer end of a corresponding blade, each collection channel being covered by a perforated plate, the outer surface contour of said plate being continuous with the blade pressure surface for providing a flow path for steam;

a first set of collection bores, each of the bores being coupled to a corresponding collection channel in a stationary blade, said bores extending from the outer end of each blade through its corresponding blade shroud and through the turbine casing to an outer surface thereof for leading steam from the collection channels of fixed blades through the turbine casing;

an annular collection chamber for each rotating blade comprising a space between the outer ends of the rotating blades in a row and the inner wall of the turbine casing, said space being enclosed by a pair of sealing rings attached at their outer circumference to the casing inner wall on either side of a corresponding blade row and in contact at their inner circumference with the outer ends of the rotating blades;

a connecting bore extending from the outer end of each collection channel in a rotating blade through the associated shroud band to said annular collection chamber for receiving steam from said channels;

a second set of circumferentially spaced collection bores extending through the turbine casing to an outer surface thereof adjacent each annular collection chamber for leading steam from each collection chamber through the turbine casing; and suction means connected to said first and second sets of collection bores for extracting collected steam and for maintaining pressure within said collection channels at a lower level than pressure in the blade path within the turbine.

17. In a reheat steam turbine having at least one high pressure turbine seciton with an impulse chamber and an exhaust stage, the steam turbine having other sections and zones wherein the pressure is lower than that of the exhaust stage of the high pressure section, the high pressure section having a plurality of rows of rotating blades attached to the turbine rotor alternating with rows of fixed blades attached to an inner wall of a casing surrounding the turbine, each of the blades having a pressure surface and a suction surface, the blades of each row being connected at their radially outer ends to shroud bands, the casing inner wall having sealing rings attached adjacent each shroud band of a rotating blade row to minimize steam leaking past the shroud bands, a system for reducing windage heating and resulting distress to turbine blades by prevention of Coanda-type flow, comprising:

outlet means located upstream of the exhaust stage of the high pressure section, for extraction of steam therethrough;

first duct means connecting said outlet means to a lower pressure zone of the turbine;

first valve means connected to said duct means for controlling steam flow through said outlet means;

inlet means coupled to said impulse chamber for introduction of exhaust steam from the exhaust stage of the high pressure section;

second duct means connected between said inlet means and the exhaust stage;

second valve means connected to said second duct means for controlling the flow of exhaust steam into the impulse chamber;

a collection channel formed within selected ones of the turbine blades, each collection channel extending from an inner end to a radially outer end of a corresponding blade immediately below and substantially parallel to the pressure surface of the blades, each channel communicating externally of the blade by a plurality of holes extending into the channels from the pressure surface of the blade;

a first set of collection bores, each of the bores being coupled to a corresponding collection channel in a stationary blade, said bores extending from the outer end of each blade through its corresponding blade shroud and through the turbine casing to an outer surface thereof for leading steam from the collection channels of fixed blades through the turbine casing;

an annular collection chamber for each row of rotating blades comprising a space between the outer ends of the rotating blades in a row and the inner wall of the turbine casing, the space being enclosed by a pair of sealing rings attached at their outer circumference to the casing inner wall on either side of a corresponding blade row and in contact at their inner circumference with the outer ends of the rotating blades;

a connecting bore extending from the outer end of each collection channel in a rotating blade through the associated shroud band to said annular collection chamber for receiving steam from said channels;

a second set of circumferentially spaced collection bores extending through the inner wall of the turbine casing to an outer surface thereof adjacent each annular collection chamber for leading steam from each collection chamber through the turbine wall; and suction means connected to said first and second sets of collection bores for extracting collected steam and for maintaining pressure within said collection channels at a lower level than pressure in the blade path within the turbine.

18. A method for reducing windage heating and resulting distress to turbine blades of a reheat steam turbine having a high pressure section with an impulse chamber, and an exhaust stage, wherein steam flows through a plurality of rows of fixed and rotating blades, each of said blades having a pressure surface and a suction surface, the steam turbine having other sections and zones wherein the pressure is lower than that of the exhaust stage of the high pressure section, the method comprising the steps of:

after a turbine trip, extracting steam from the high pressure section at a point just upstream of the exhaust stage and dumping the extracted steam to a lower pressure zone;

introducing exhaust steam from the exhaust stage of the high pressure section into the impulse chamber of the high pressure section; and suctioning steam from the pressure surfaces of selected ones of the turbine blades.

* * * * *